US005140750A

United States Patent [19]

Maguire

[11] Patent Number: 5,140,750

[45] Date of Patent: Aug. 25, 1992

[54] SPIRAL SHRINK SLEEVE

[75] Inventor: Michael Maguire, Waycross, Ga.

[73] Assignee: Scapa, Inc., Waycross, Ga.

[21] Appl. No.: 705,968

[22] Filed: May 28, 1991

Related U.S. Application Data

[62] Division of Ser. No. 622,967, Dec. 6, 1990, Pat. No. 5,067,217.

[51] Int. Cl.[5] ..... B21H 1/14; B21K 1/02

[52] U.S. Cl. ..... 29/895.21; 29/895.23; 29/121.3

[58] Field of Search ..... 29/895.2, 895.21, 895.211, 29/895.212, 895.23, 121.3

[56] References Cited

U.S. PATENT DOCUMENTS

| | | | |
|---|---|---|---|
| 199,359 | 1/1878 | Dunbar | 29/121.3 |
| 934,076 | 9/1909 | Kneuper | 29/121.3 X |
| 1,281,940 | 10/1918 | Goedike | 29/895.23 X |
| 1,415,918 | 5/1922 | Browne | 29/895.23 X |
| 2,080,127 | 5/1937 | Goedike | 29/120 |
| 2,117,593 | 5/1938 | Backofen | 29/120 |
| 2,478,262 | 8/1949 | Gay et al. | 29/120 X |
| 2,621,507 | 12/1952 | Pharris et al. | 29/120 X |
| 2,663,074 | 12/1953 | Schultheis | 29/895.23 |
| 2,711,575 | 6/1955 | Zesbaugh | 29/895.23 |
| 2,804,762 | 9/1957 | Kameda | 29/120 X |
| 3,030,250 | 4/1962 | Losse | 29/895.23 X |
| 3,057,044 | 10/1962 | Davis | 29/121.5 X |
| 3,180,115 | 4/1965 | Marshall | 29/120 X |
| 3,436,041 | 4/1969 | Haller | 29/895.212 X |
| 3,814,054 | 6/1974 | Tajihi | 29/132 X |
| 3,926,701 | 12/1975 | Nishiwaki | 29/120 X |
| 4,639,291 | 1/1987 | Ota et al. | 29/132 X |
| 5,067,217 | 11/1991 | Maguire | 29/121.3 |

FOREIGN PATENT DOCUMENTS 0934408 10/1955 Fed. Rep. of Germany .

*Primary Examiner*—Timothy V. Eley
*Assistant Examiner*—C. Richard Martin
*Attorney, Agent, or Firm*—Fleit, Jacobson, Cohn, Price, Holman & Stern

[57] ABSTRACT

An open ended, flat spiral belt is joined at its ends on a roll to form an endless cover. A spiral belt is fitted with a zipper assist in the seam area to facilitate the joining of the spiral belt on the roll. One part of the zipper assist is removably attached to one end of the spiral belt with the other part of the zipper assist being removably attached to the other end of the spiral belt. When the two sections of the zipper assist are zipped together, they pull the two ends of the spiral belt together, allowing for interdigitation of the spiral loops of the spiral belt, which then forms a channel for the introduction of a seam wire. Once the spiral belt is seamed on the roll, the zipper assist is removed and the roll is set in slow motion at about ten revolutions per minute. The entire fabric is subjected to application of heat from a hot air gun to set the spiral belt, now in the form of a spiral shrink sleeve.

4 Claims, 3 Drawing Sheets

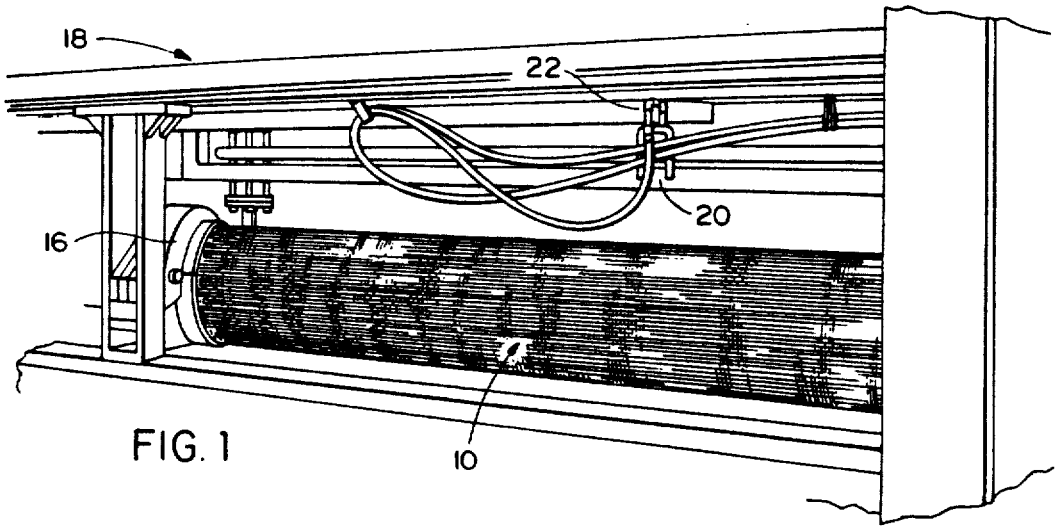
FIG. 1
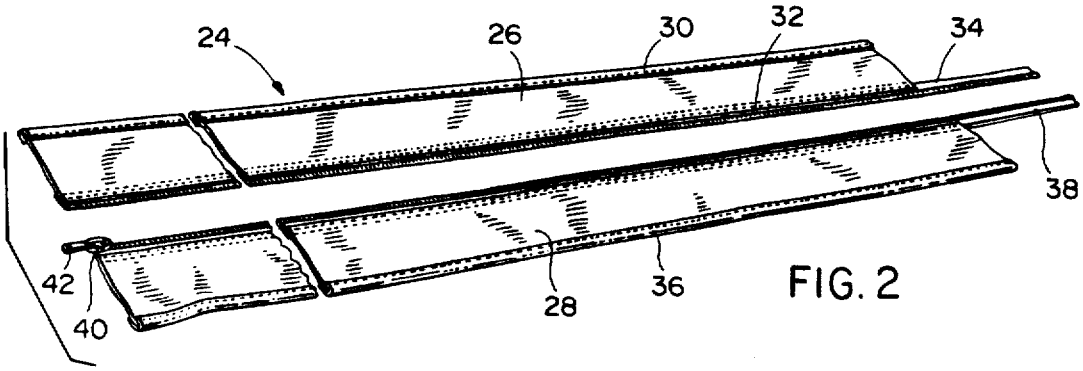
FIG. 2
FIG. 6
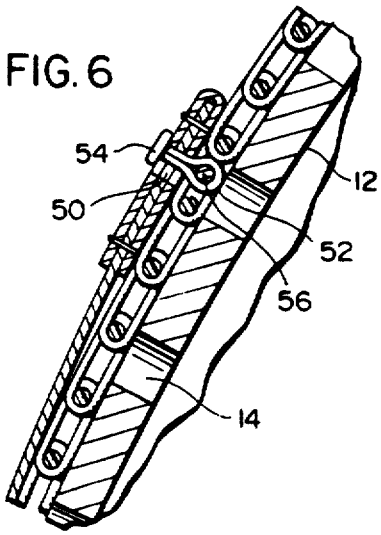
FIG. 7
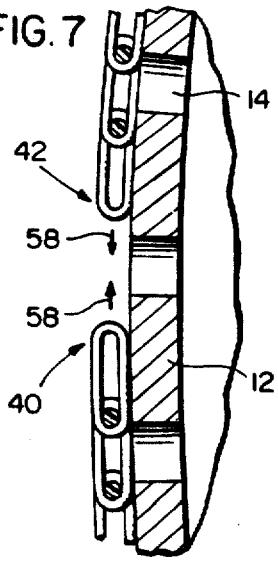
FIG. 8
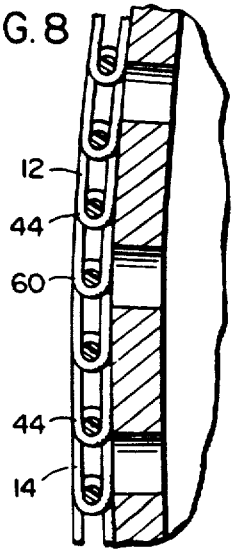

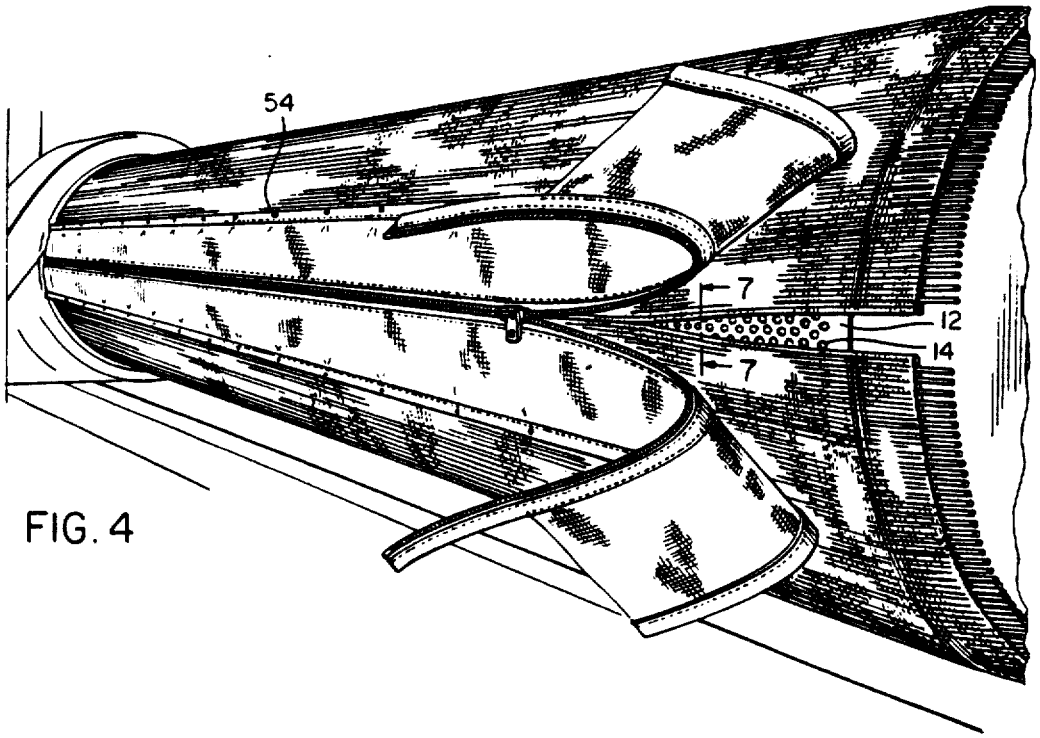
FIG. 4
FIG. 5
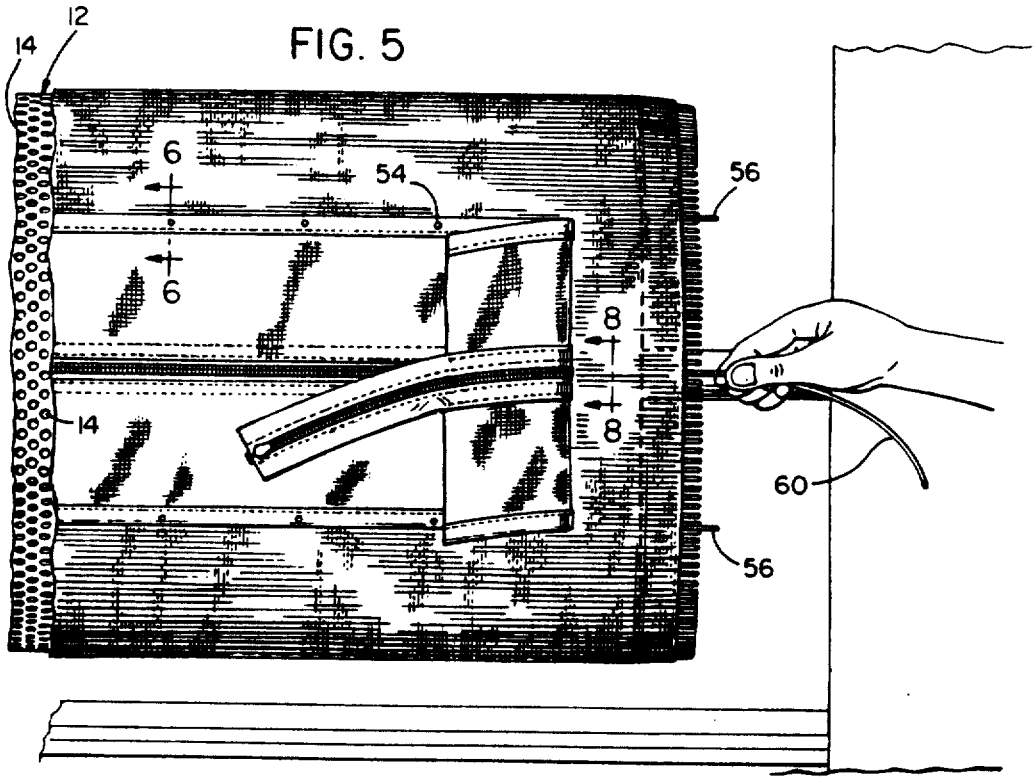

SPIRAL SHRINK SLEEVE

This is a divisional application of application Ser. No. 07/622.967, filed Dec. 6, 1990 now U.S. Pat. No. 5067.217.

FIELD OF THE INVENTION

An open ended spiral shrink sleeve is disclosed to cover a perforated vacuum roll, usually a couch roll.

BACKGROUND OF THE INVENTION

Shrink sleeves are used to cover perforated rolls, in the nature of couch rolls. The covered roll is placed in direct contact with a fiber mat for the purpose of extracting moisture from the mat by both pressure and suction.

An alternative application of a covered roll is to collect fibrous material from a drum or vat, the fibrous material being held to the covered roll by suction. As the surface of the covered roll leaves the vat, the fibrous material is doctored off by a doctor blade, onto a belt.

Due to the critical nature of the processes in which these covered rolls run, the covers cannot have a seam. It is not possible, for example, to weave a flat fabric, seam it and then join the seam as the fabric is wrapped around a roll. Therefore, shrink sleeves have been woven as endless pieces. To install these shrink sleeves requires the dismantling of a machine, removing a roll, sliding the woven shrink sleeve over the roll and then rebuilding the machine with the covered roll. At the same time, steam has to be applied to the fabric to cause it to shrink, to thereby fit tightly on the roll. The application of steam involves fitting a temporary steam shower over the roll and then removing the steam shower before the machine starts up as the position of the shower interferes with the operation of the machine.

Some problems presently encountered by the use of endless woven shrink sleeves are that the sleeves: 1) suffer from premature wear, 2) require 14 to 16 hours to install the woven endless sleeve, which is excessive, and 3) the cost of the woven endless sleeve has proven expensive.

SUMMARY OF THE INVENTION

By the present invention, the problems encountered with prior practices have been overcome. A spiral belt construction is used in place of an endless woven sleeve. An open ended, flat spiral belt is produced which is joined at its ends on a roll to form an endless cover.

A spiral belt is fitted with a zipper assist in the seam area to facilitate the joining of the spiral belt on the roll. One part of the zipper assist is removably attached to one end of the spiral belt with the other part of the zipper assist being removably attached to the other end of the spiral belt. When the two sections of the zipper assist are zipped together, they pull the two ends of the spiral belt together, allowing for easy interdigitation of the spiral loops of the spiral belt, which then forms a channel for the introduction of a seam wire.

Once the spiral belt is seamed on the roll, the zipper assist is removed and the roll is set in slow motion at about ten revolutions per minute. The entire fabric is subjected to application of heat from a hot air gun to set the spiral belt, now in the form of a spiral shrink sleeve.

The use of a spiral belt construction improves the fabric life by at least four times over prior practices, reduces installation time from 14 to 16 hours down to two hours, and the overall cost of the product is reduced.

The spiral sleeve of the invention is manufactured from a high shrink, contaminant resistant monofilament material.

When a covered suction roll contacts a sheet to extract moisture from the sheet, the spiral sleeve picks up the fines and fibers from the sheet. It is necessary that these contaminants are cleaned off the cover before the cover again contacts the sheet. This is achieved by the use of oscillating showers which constantly clean the sleeve as the roll rotates. The use of contaminant resistant yarns allows for easier removal of the fines and fibers from the sleeve.

The spiral coil material can have either a round or flat cross-section. A 0.7 mm round polyester monofilament material is preferred with a 0.9 mm round polyester monofilament material used as the joining wire.

The spiral fabric used may be manufactured and assembled by the methods described in U.S. Pat. No. 4,388,264 and U.S. Pat. No. 4,488,347 to Leuvelink. During assembly, the joining wires are made to extend beyond the edge of the fabric by at least six inches on either side of the roll and are held in position within the fabric by two rows of hot melt glue applied to each edge of the fabric. The fabric is not heat set except for the two ends which form the seam. Partial heat setting of the seam area is done to facilitate seaming on the suction roll. Once the non-heat set fabric is installed on the roll, the edges of the sleeve are trimmed inside the glue lines and these edge pieces discarded. The installed fabric is then heat treated with a hot air gun.

The present invention recognizes the use of spiral technology to create an endless and seamless product when installed on a suction roll. This product has resulted in overcoming two major problems with present woven endless shrink sleeves, namely, premature wear and amount of time for installation.

It is an object of the present invention to form a seamless spiral belt and an endless cover for a suction roll.

It is another object of the present invention to form a seamless spiral belt and an endless cover for a suction roll with the spiral belt formed as an open ended flat belt, joined on the roll to form an endless cover.

It is yet another object of the present invention to form a seamless spiral belt and an endless cover for a suction roll with the spiral belt formed as an open ended flat belt, joined on the roll to form an endless cover with the ends of the flat belt interengaged by a zipper assist after which a seam wire is introduced into a channel formed by interdigitated spiral loops of the opposed ends of the belt.

It is still yet another object of the present invention to form a seamless spiral belt and an endless cover for a suction roll with the spiral belt formed as an open ended flat belt, joined on the roll to form an endless cover with the ends of the flat belt interengaged by a zipper assist after which a seam wire is introduced into a channel formed by interdigitated spiral loops of the opposed ends of the belt with the zipper assist being removed after insertion of the seam wire.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 is a perspective view of a perforated roll having a seamless spiral belt with a shower attachment located proximate to the roll.

FIG. 2 illustrates two sections of a zipper assist.

FIG. 4 illustrates zippering of the two sections of the zipper assist to join the opposite ends of the open ended flat spiral belt on a perforated roll.

FIG. 5 illustrates the insertion of a seam wire through a channel formed by the interdigitated spiral loops of the opposite ends of a flat spiral belt located on a perforated roll.

FIG. 6 is a sectional view taken along line 6—6 of FIG. 5.

FIG. 7 is a sectional view taken along line 7—7 cf FIG. 4.

FIG. 8 is a sectional view taken along line 8—8 of FIG. 5.

DETAILED DESCRIPTION OF THE PREFERRED EMBODIMENTS

Figure 3:
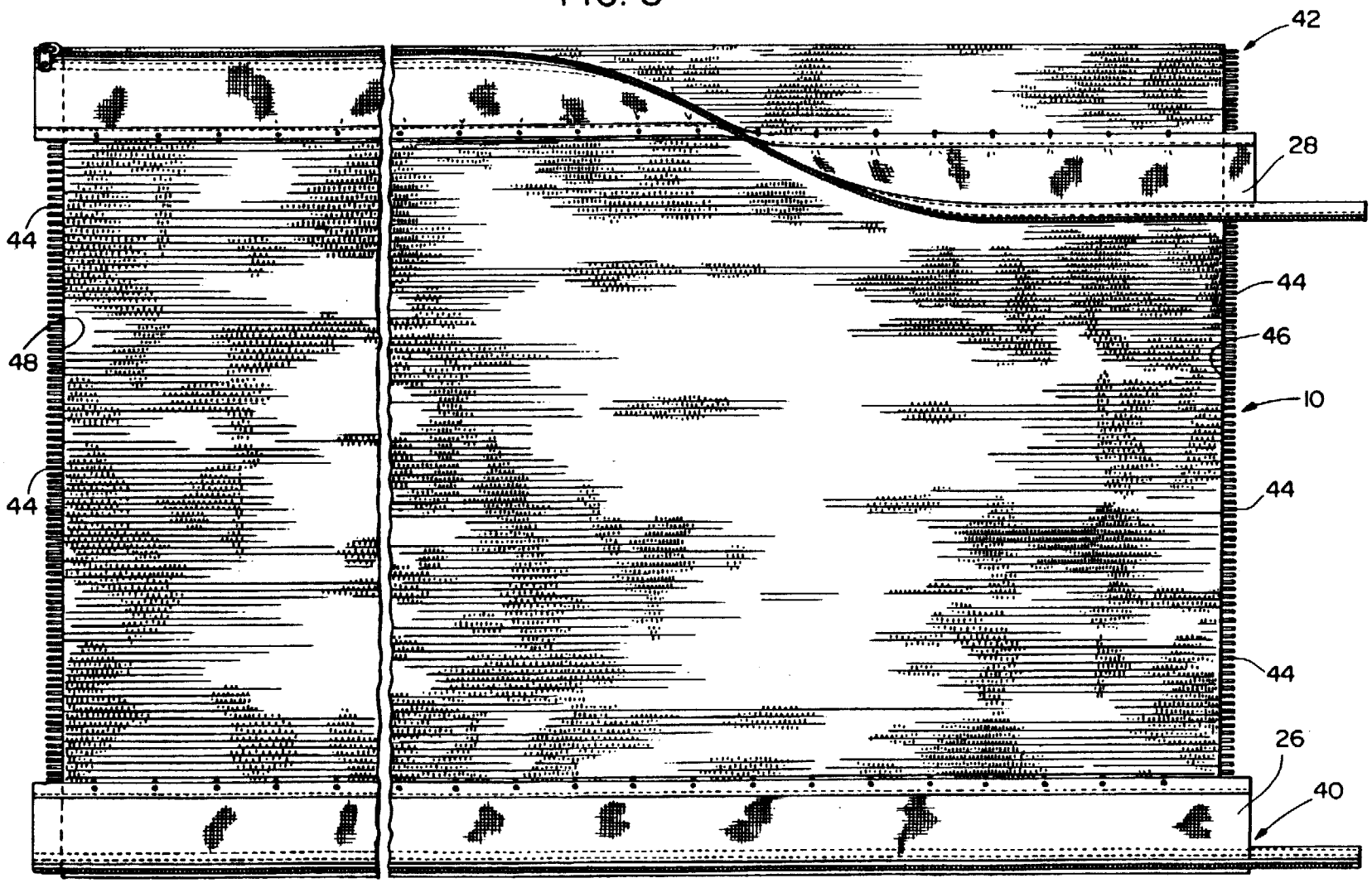
FIG. 3 illustrates an open ended, flat spiral belt with a section of the zipper assist secured to each end of the belt.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, an endless, seamless spiral belt embodying the teachings of the subject invention is generally designated by reference numeral 10. The belt 10 is mounted on a suction roller 12 having a plurality of perforations 14 for passage of air. The roll 12 is mounted in chocks 16 within a machine 18, as shown in FIG. 1. A showerhead 20 is reciprocatedly mounted along a track 22 located above the belt 10 for washing of fibers and fines from the belt upon release of the vacuum suction through the perforations 14.

For forming the belt 10 on the roll 12 in a seamless form, a zipper assist 24 is used as is shown in FIG. 2. The zipper assist includes two sections 26 and 28 which are of a length greater than the roll to which the belt is to be applied. Section 28 includes a thickened outward lateral edge 30 and an inner lateral edge 32 onto which is sewn one portion 34 of a zipper. On section 28 is an outer lateral edge 36 corresponding to edge 30, with an inner lateral edge forming a complementary zipper portion 38 onto which is mounted a zipper slide 40 having handle 42. The zipper assist may be made of fabric or other suitable material.

In FIG. 3, the spiral belt 10 is shown in a flattened condition. The belt includes two opposite ends, one end 40 having zipper assist portion 26 removably secured thereto and opposite end 42 having zipper assist portion 28 removably secured thereto.

In FIG. 3, joining wires 44 extend beyond the edges 46 and 48 of the belt 10 by at least six inches. The joining wires 44 are held in position within the fabric of belt 10 by a row of hot melt glue applied to each edge 46, 48 of the fabric. The fabric is not heat set except for the two ends 40, 42, which will form the seam. Partial heat setting of this seam area is done to facilitate seaming on the roll 12, before the zipper is attached.

The zipper assist sections 26, 28 are removably secured to the belt 10 by passage of a loop 50 through the edges 30, 36 of the zipper assist sections 26, 28, respectively. The loop 50 includes an open channel section 52 which passes through the fabric of belt 10. A flattened head portion 54 is retained by the edges 30, 36 of the belt 10. When a plurality of the loops 50 have been extended through the zipper assist and extend through the belt 10, a metal wire pin 56 is threaded through the channel loops 52, underneath the belt 10, to secure the zipper assist on the face of the belt 10.

The edges 30, 36 of the zipper assist are located on the belt such that when the zipper assist portions are secured together by zipper 40, there will be a slight overlap of the ends 40, 42 of the belt so as to intermesh the ends of the belt together. The edges 30, 36 of the zipper assist sections are removably secured to the belt at a distance from ends 40, 42 less than the width of the zipper assist sections 26, 28. This spacing is desired so that upon zippering together of the zipper assist sections, the loops at the ends 40, 42 of the spiral belt 10 will interengage with each other.

When the belt 10 is laid on the roll 12, the two edges 34, 38 of the zipper are interengaged by moving of the zipper 40 along the length of zipper portions 34, 38. As shown in FIGS. 4 and 7, as the zipper 40 is moved longitudinally, the ends 40, 42 of the belt 10 are moved into engagement with each other for interdigitation of the spiral loops located at the ends 40, 42 of the belt 10.

As shown in FIGS. 5 and 8, as the zipper 40 is moved longitudinally along the zipper assist sections, a channel is formed between the loops at the ends 40, 42 as the ends are drawn towards each other as shown by the arrows 58 in FIG. 7. Once the spiral loops of the ends 40, 42 are interdigitated by the closing of the zipper, as shown in FIGS. 5 and 8, a seam or joining wire 60 is manually threaded through the aligned openings of the ends 40, 42 of the belt 10.

To aid in the visual inspection of the seam wire 60 being threaded through the interengaged ends 40, 42 of the belt 10, the zipper 40 is slowly opened and the seam wire is continuously fed through the overlapped ends 40, 42 to secure the ends 40, 42 together.

The pins 56 are then withdrawn from under the belt 10 and from the loops 52. The zipper assist is then removed from the belt leaving a seamless spiral shrink sleeve on the roll without having to remove the roll from its assembly.

The roll is then slowly rotated and the entire spiral belt 10 is subjected to application of heat from a hot air gun. The spiral belt is thereby set. The spiral belt 10 then forms an endless and seamless belt. The joining wires 44 are then trimmed inside the glue lines and these edge pieces discarded.

Having described the invention, many modifications thereto will become apparent to those skilled in the art to which it pertains without deviation from the spirit of the invention as defined by the scope of the appended claims.

I claim:

1. A method of forming an endless spiral shrink sleeve on a roll, said method comprising:

mounting a belt having two ends on a roll, drawing the two ends together by a zipper assist removably mounted on the belt so as to interengage the two ends and form a channel, threading a joining wire through the channel to secure the two ends together, and heat treating the belt.

2. A method as claimed in claim 1, wherein the belt includes contaminant resistant monofilament material.

3. A method as claimed in claim 2, wherein the joining wire is made of contaminant resistant monofilament material.

4. A method as claimed in claim 1, wherein the zipper assist includes two sections removably mounted at the ends of the belt and secured to the belt at a distance from the ends of the belt so that upon zippering of the zipper assist, the ends of the belt are interengaged to form the channel.

* * * * *